US005564958A

United States Patent [19]

Itoh et al.

[11] Patent Number: 5,564,958

[45] Date of Patent: Oct. 15, 1996

[54] METHOD FOR MANUFACTURING DISPLAY DEVICE

[75] Inventors: Shigeo Itoh; Mikio Yokoyama; Takeshi Tonegawa; Yuji Uchida; Teruo Watanabe, all of Mobara, Japan

[73] Assignee: Futaba Denshi Kogyo Kabushiki Kaisha, Mobara, Japan

[21] Appl. No.: 437,786

[22] Filed: May 9, 1995

[30] Foreign Application Priority Data

May 10, 1994 [JP] Japan ..... 6-119675

[51] Int. Cl.[6] ..... H01J 9/38

[52] U.S. Cl. ..... 445/6; 445/42; 445/56

[58] Field of Search ..... 445/16, 17, 18, 445/15, 24, 6, 42, 56

[56] References Cited

U.S. PATENT DOCUMENTS

| | | | |
|---|---|---|---|
| 3,687,513 | 8/1972 | Holz | 445/24 |
| 3,901,573 | 8/1975 | Dolenga et al. | 445/56 |
| 4,018,490 | 4/1977 | Berkenblit et al. | 445/42 |
| 4,898,558 | 2/1990 | Shaffer | 445/41 |
| 5,022,880 | 6/1991 | Shaffer | 445/6 |

FOREIGN PATENT DOCUMENTS

| | | | |
|---|---|---|---|
| 57-13649 | 1/1982 | Japan | 445/24 |
| 4-274134 | 9/1992 | Japan | 445/24 |

*Primary Examiner*—P. Austin Bradley
*Assistant Examiner*—Jeffrey T. Knapp
*Attorney, Agent, or Firm*—Oblon, Spivak, McClelland, Maier & Neustadt, P.C.

[57] ABSTRACT

A method for manufacturing a display device is available that is capable of remarkably improving life characteristics of a display device. A display device placed in a chamber is evacuated to about $10^{-7}$ Torr. Then, reducing gas is introduced into the display device and held therein for several minutes, followed by evacuation of the display device to about $10^{-5}$ Torr. The reducing gas introducing and discharge steps are repeated several times. Thereafter, evacuation of the display device is carried out while keeping the chamber at about 300° C., followed by sealing of the display device.

2 Claims, 6 Drawing Sheets

LIFE CHARACTERISTICS (SURVIVAL RATE)

VARIATION IN I-V CHARACTERISTICS BY GAS CLEANING

METHOD FOR MANUFACTURING DISPLAY DEVICE

BACKGROUND OF THE INVENTION

This invention relates to a method for manufacturing a display device, and more particularly to a method for manufacturing a display device including an electron emission means and a luminous means excited by electrons emitted from the electron emission means.

A method for manufacturing a display device which has been conventionally carried out in the art will be described with reference to FIG. 8. Apparatus shown in FIG. 8 is constructed so as to carry out vacuum evacuation of a display device. For this purpose, it is adapted to evacuate the display device to a pressure at which sealing of the display device is carried out.

In FIG. 8, a display device 102 is formed by sealedly joining a cathode substrate made of, for example, glass and having a cathode for emitting electrons therefrom arranged thereon and an anode substrate made of, for example, glass and having an anode for capturing the emitted electrons arranged thereon to each other in a manner to be spaced from each other at a predetermined interval. The apparatus for evacuating the display device 102 thus formed includes a chamber 101 which is provided therein with a heater and in which the display device 102 is received for evacuation and a vacuum evacuation unit connected to the chamber 101 and including a head 103 connected to an evacuation tube for evacuating the display device 102. In the prior art shown in FIG. 8, the head 103 is constructed so as to permit the display device 102 to be arranged in the chamber 101.

The head 103 is connected through a valve 104 to a manifold 105, which is then connected through valves 112 and 106 to a dry pump 107. The manifold 105 is also connected to a gate valve 108, which is then connected to a turbo-molecular pump 110. The turbo-molecular pump 110 is connected through a valve 111 to the dry pump 107. Now, the manner of operation of the apparatus thus constructed will be described hereinafter.

First, the display device 102 is received in the chamber 101 and the evacuation tube is connected to the head 103. Then, the valve 112 is rendered open to permit the manifold 105 to communicate with the dry pump 107, so that evacuation of the display device 102 to a rough vacuum may be carried out through the manifold 105, valve 104, head 103 and evacuation tube. The rough evacuation causes a pressure in the display device 102 to be reduced to a certain degree. Then, the valve 112 is closed and the gate valve 108 is rendered open, resulting in the turbo-molecular pump 110 communicating with the manifold 105, so that evacuation of the display device 102 to a vacuum may be accomplished through the manifold 105, valve 104, head 103 and evacuation tube, during which the valve 111 is kept open to back up the turbo-molecular pump 110 by means of the dry pump 107.

Then, the gate valve 108 is rendered open and concurrently the heater is turned on to heat an interior of the chamber 101 to a temperature of about 350° C., resulting in the chamber 101 being kept at about 350° C.

Then, the evacuation is continued for a few or several hours under such conditions, so that the display device 102 may be evacuated to a pressure as low as about $10^{-7}$ Torr and then the evacuation tube is sealedly closed to keep the display device at a high vacuum.

A temperature profile in the process described above, as shown in FIG. 9, is so set that a temperature is increased to about 350° C. by operation of the heater arranged in the chamber 101 after the rough evacuation and then kept at about 350° C. for a few or several hours. Then, the temperature is gradually decreased to a predetermined level while continuing the evacuation, followed by sealing of the evacuation tube. Thus, the display device 102 is evacuated while being subject to baking so as to facilitate discharge of gas from the display device.

Unfortunately, the display device thus manufactured has a disadvantage of being deteriorated in life characteristics (survival rate), although it is evacuated to a high vacuum while being subject to baking. Also, it has another disadvantage that an increased period of time is required for evacuation of the display device to a high vacuum.

The above-described deterioration in life characteristics (survival rate) of the display device would be due to the fact that gas generated in the display device 102 is insufficiently discharged therefrom. Phosphors and electrodes made of various materials which have gas absorbed thereon are arranged in the display device. Unfortunately, even baking fails to permit the gas absorbed on the materials to be satisfactorily discharged therefrom. Thus, the gas is caused to be gradually discharged from the materials when the display device 102 is operated for display after sealing, resulting in polluting an electron emission source and the like arranged in the display device, leading to deterioration in life characteristics (survival rate) of the display device.

Manufacturing of a display device which solves the above-described problems of the prior art is proposed in Japanese Patent Application Laid-Open Publication No. 299129/1990. The techniques proposed are adapted to feed a display device with electricity during vacuum evacuation of the display device, to thereby activate an electron emission source of the display device and concurrently hit anodes with electrons emitted from the electron emission source to discharge gas absorbed on the anodes therefrom.

Unfortunately, the proposed techniques fail to sufficiently discharge gas from the display device, to thereby fail to significantly improve life characteristics of the display device.

SUMMARY OF THE INVENTION

The present invention has been made in view of the foregoing disadvantage of the prior art.

Accordingly, it is an object of the present invention to provide a method for manufacturing a display device which is capable of permitting life characteristics of a display device to be remarkably improved.

It is another object of the present invention to provide a method for manufacturing a display device which is capable of permitting gas adsorbed on elements arranged in display device to be effectively discharged therefrom.

It is a further object of the present invention to provide a method for manufacturing a display device which is capable of providing a display device with increased luminance.

In accordance with the present invention, a method for manufacturing a display device is provided. The method includes the step of placing a flat-type display device in a heating chamber. The flat-type display device includes a vacuum envelope and an electron emission means arranged in the vacuum envelope. The method also includes the steps of evacuating the display device to a vacuum while subjecting it to baking, introducing gas into the display device evacuated to a vacuum and holding it therein, and discharging gas from the display device by evacuation to form a vacuum in the display device.

Also, in accordance with the present invention, a method for manufacturing a display device is provided. The method includes the steps of evacuating a display device provided with at least an electron emission means to a vacuum, feeding the electron emission means with electricity while subjecting the display device to baking, introducing gas into the display device and holding it therein, evacuating the display device to a vacuum, and repeating the above-described steps plural times.

In a preferred embodiment of the present invention, the gas may be reducing gas.

In a preferred embodiment of the present invention, the method further includes the steps of evacuating the display device to a pressure at which the display device is sealed without exposing it to an atmosphere and sealing the display device.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a method for manufacturing a display device according to the present invention will be described hereinafter with reference to FIGS. 1 to 7.

First, an apparatus for vacuum evacuation will be described now with reference to FIG. 1 prior to description of a method of the present invention.

Figure 1:
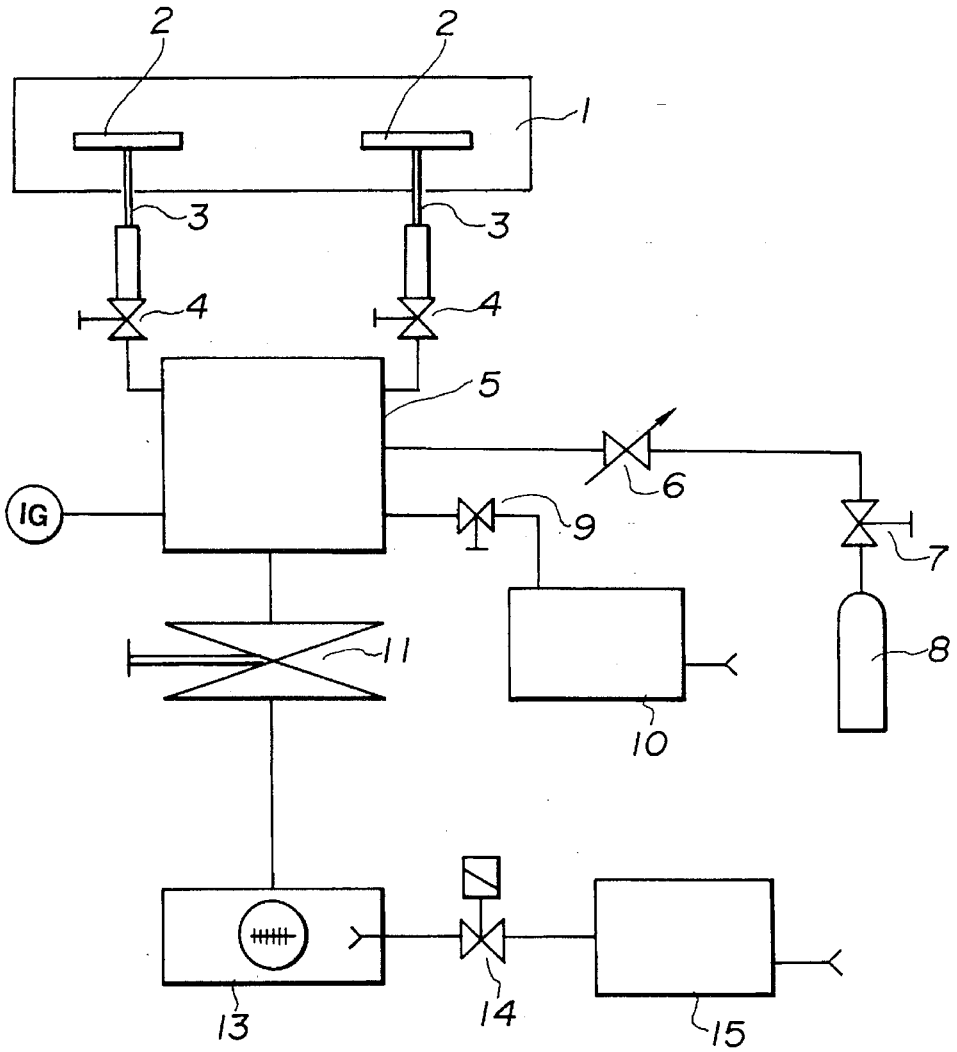
FIG. 1 is a diagrammatic view showing an apparatus for carrying out vacuum evacuation which may be used in an embodiment of a method for manufacturing a display device according to the present invention.
Figure 2:
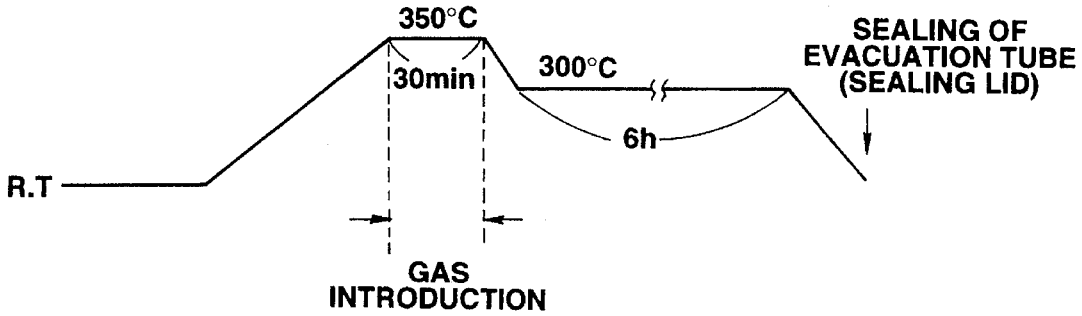
FIG. 2 is a diagrammatic view showing a temperature profile obtained in an embodiment of the present invention.

In FIG. 1, a display device designated at reference numeral 2 is made by sealedly joining a cathode substrate formed of, for example, glass and having an electron emitting cathode arranged thereon and an anode substrate formed of, for example, glass and having an anode for capturing electrons emitted from the cathode arranged thereon to each other with a gap of a predetermined interval being defined therebetween. The display device 2 is placed in a chamber 1 in which a heater is arranged. The display device 2 is evacuated to a vacuum by means of an evacuation tube connected to a head 3 of a vacuum evacuation unit. In the illustrated embodiment, a plurality of display devices 2 are placed in the chamber 1 and a plurality of heads 3 are arranged, so that two display devices 2 may be concurrently evacuated to a vacuum.

The heads 3 are connected through valves 4 to a manifold 5, respectively, which is then connected through a flow control valve 6 and a valve 7 to a gas bomb 8, as well as through a valve 9 to a first dry pump 10. Also, the manifold 5 is connected to a gate valve 11, which is then connected to a turbo-molecular pump 13. Also, the turbo-molecular pump 13 is connected through a valve 14 to a second dry pump 15.

Now, a first embodiment of a method for manufacturing a display device according to the present invention will be described with reference to FIG. 1.

The display devices 2 each including an envelope, as well as a cathode substrate and an anode substrate each received in the envelope is placed in the chamber 1 and then the evacuation tube of each of the display devices 2 is connected to each of the heads 3. Then, the valve 9 is rendered open to permit the manifold 5 to communicate with the first dry pump 10, resulting in rough evacuation of the display device being carried out through the manifold 5, valve 4, head 3 and evacuation tube. The rough evacuation causes a pressure in the display device 2 to be reduced to a certain degree, followed by closing of the valve 9 and opening of the gate valve 11. This results in the turbo-molecular pump 13 communicating with the manifold 5, to thereby evacuate an interior of the display device 2 through the manifold 5, valve 4, head 3 and evacuation tube. In this instance, the valve 14 is kept open to back up the second drive pump 15 by means of the turbo-molecular pump 13.

Then, the gate valve 11 is rendered open and simultaneously the heater is operated to increase a temperature in the chamber to a level of about 350° C. Then, evacuation of display device is continued while keeping the temperature at the level, to thereby form a pressure as low as about $10^{-7}$ Torr in the display device 2.

Then, closing of the gate valve 11 and opening of the valve 7 are carried out while keeping a temperature in the chamber 1 at about 350° C., to thereby introduce reducing gas into the display device 2. Introduction of the reducing gas is carried out while adjusting a flow rate of the reducing gas by means of the flow control valve 6, to thereby form a pressure of $10^{-2}$ to 500 Torr in the display device 2. Thereafter, the valve 7 is closed to keep the display device at such conditions for a few or several minutes.

Then, rough evacuation of the display device 2 is carried out by means of the first dry pump 10 as required and then the gate valve 11 is rendered open to permit the turbo-molecular pump 13 to communicate with the manifold, so that evacuation of the display device 2 to a pressure as low as about $10^{-5}$ Torr is carried out through the manifold 5, valve 4, head 3 and evacuation tube.

Introduction of the reducing gas and evacuation of the reducing gas described above are repeated to 10 times or less, for example, 8 times. Then, the display device 2 is subject to evacuation for about 6 hours while keeping an interior of the chamber at about 300° C., resulting in a pressure in the display device 2 being reduced to a level as low as about $10^{-7}$ Torr, followed by sealing of the evacuation tube or a sealing lid, so that the display device 2 may be kept at a high vacuum.

A temperature profile obtained in the first embodiment of the method of the present invention constructed as described above is as shown in FIG. 2. More particularly, after rough evacuation of the display device 2, the heater arranged in the chamber 1 is operated to increase a temperature in the chamber 1 to about 350° C. Then, the chamber 1 is kept at the temperature for about 30 minutes, during which introduction of the reducing gas and evacuation of the reducing gas are repeated, for example, 8 times. Thereafter, the temperature is gradually lowered while continuing the evacuation and the evacuation tube or sealing lid is sealed when the pressure is decreased to about $10^{-7}$ Torr.

Such introduction of reducing gas into the display device 2, followed by holding of the reducing gas therein results in elements oxidized in the display device 2 being reduced by the reducing gas, so that gas discharge (hereinafter also referred to as "gas cleaning") may be carried out. In this instance, in order to facilitate gas discharge from the display device 2, the display device 2 is evacuated while being subject to baking, so that the first embodiment of the method of the present invention described above provides a display device exhibiting remarkably improved life characteristics (survival rate).

Now, effects of the above-described gas cleaning from a display device will be described with reference to FIGS. 5 to 7, supposing that the display device includes a field emission cathode.

Figure 5A:
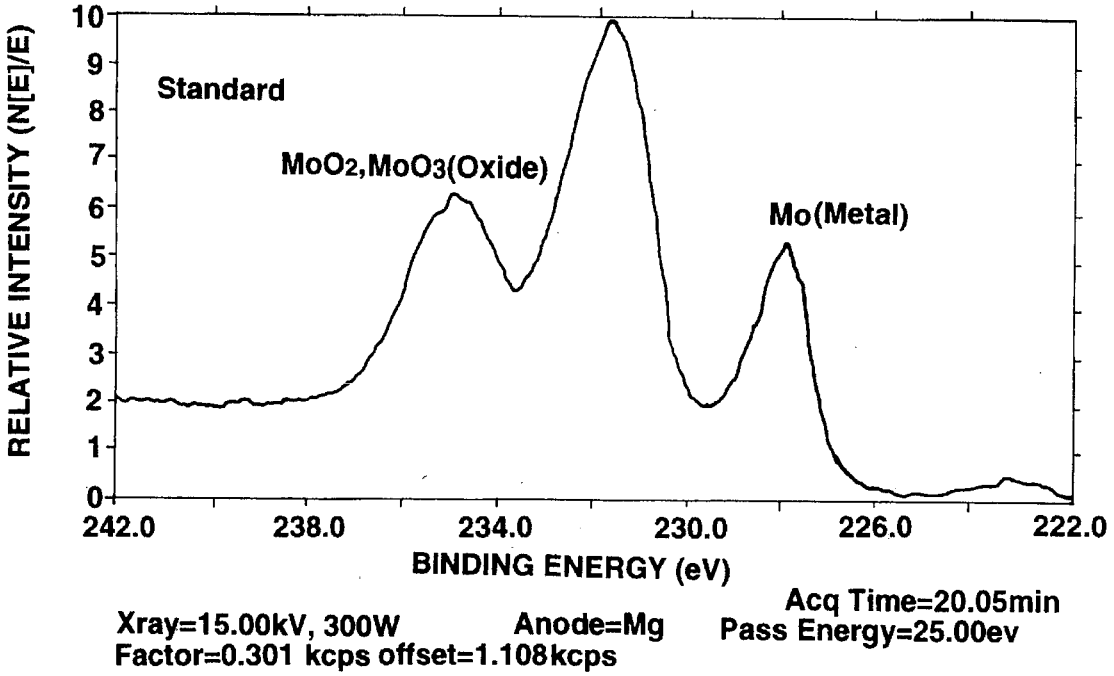
FIGS. 5(*a*) and 5(*b*) each are a graphical representation showing results of an ESCA analysis for determining effects of gas cleaning.
Figure 5B:
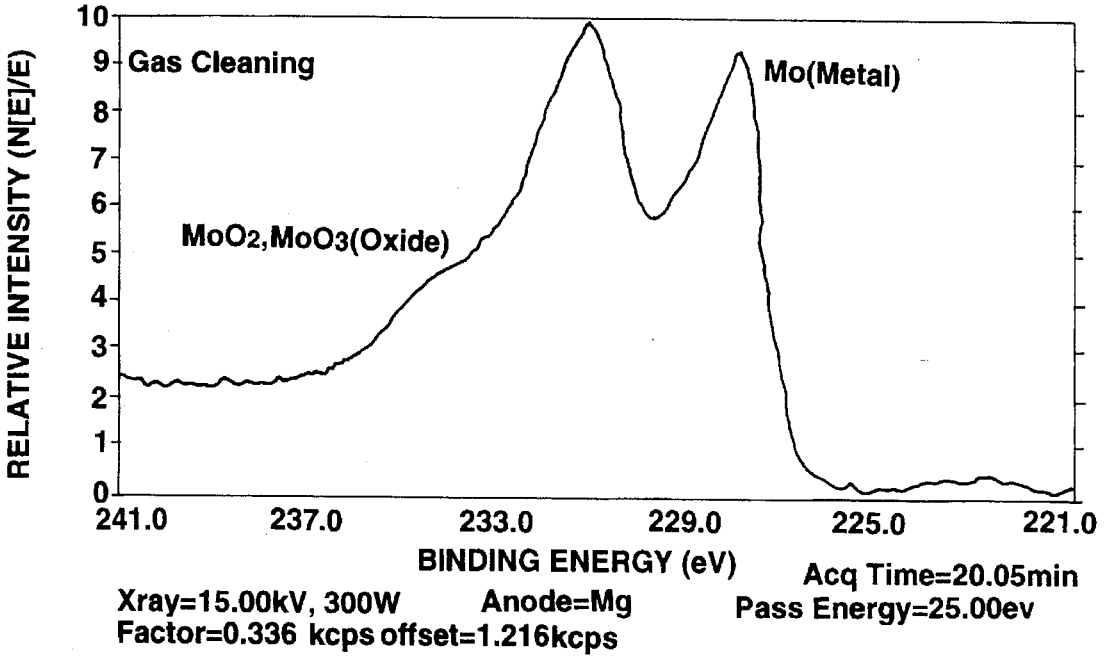

FIGS. 5(*a*) and 5(*b*) each show results of an ESCA analysis made on Mo forming the cathode and the like in the display device 2, wherein FIG. 5(*b*) shows the results obtained when the gas cleaning took place and FIG. 5(*a*) shows the results obtained when it did not take place. In FIGS. 5(*a*) and 5(*b*), an axis of abscissas indicates binding energy and an axis of ordinates indicates relative intensity N(E)/E.

FIG. 5(*a*) shows that when the gas cleaning does not take place, a spectrum of metal molybdenum (Mo) at binding energy of 228 eV and those of molybdenum oxides ($MoO_2$, $MoO_3$) each have increased intensity. This reveals that oxygen was adsorbed on molybdenum to form molybdenum oxides.

FIG. 5(*b*) shows that when the gas cleaning takes place, a spectrum of metal molybdenum at binding energy of 228 eV has increased intensity and those of molybdenum oxides ($MoO_2$, $MoO_3$) each have reduced intensity. This indicates that the oxygen oxidizing the metal molybdenum is adsorbed on the reducing gas, resulting in the molybdenum oxides being reduced to metal molybdenum.

Spectra between metal molybdenum and molybdenum oxides appear in both cases and do not have any specific meaning.

Thus, the results shown in FIGS. 5(*a*) and 5(*b*) indicate that the gas cleaning permits gas adsorbed on molybdenum to be discharged therefrom.

Figure 6:
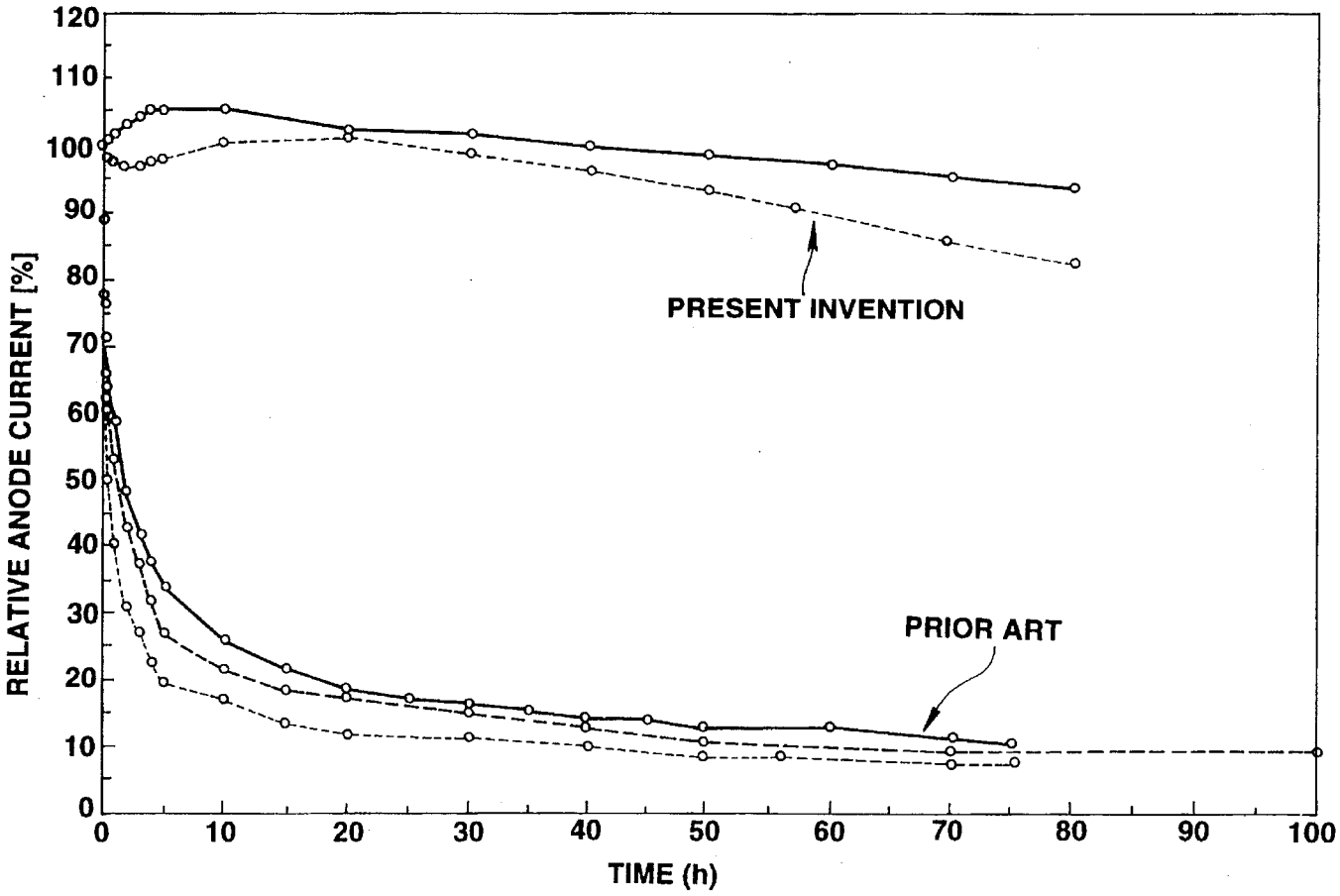
FIG. 6 is a graphical representation showing a variation in life characteristics (survival rate) of a display device by gas cleaning.

FIG. 6 shows life characteristics (survival rate) of display devices of the present invention and prior art, wherein an axis of abscissas indicates operation time and an axis of ordinates indicates a relative anode current (%). In FIG. 6, upper two curves indicate life characteristics (survival rate) of an electron emission means of a display device manufactured by the method of the present invention wherein gas cleaning takes place and lower three curves indicates life characteristics (survival rate) of a display device manufactured by the conventional method wherein gas cleaning does not take place.

From a point of view of life characteristics (survival rate), the display device manufactured by the conventional method is decreased in survival rate of an electron emission means to 20% when it is operated for a period of time as short as about 5 hours, whereas the display device manufactured by the present invention exhibits a survival rate of an electron emission means above about 80% even when it is operated for 80 hours. Thus, FIG. 6 indicates that the gas cleaning permits life characteristics of a display device to be highly improved.

Figure 7:
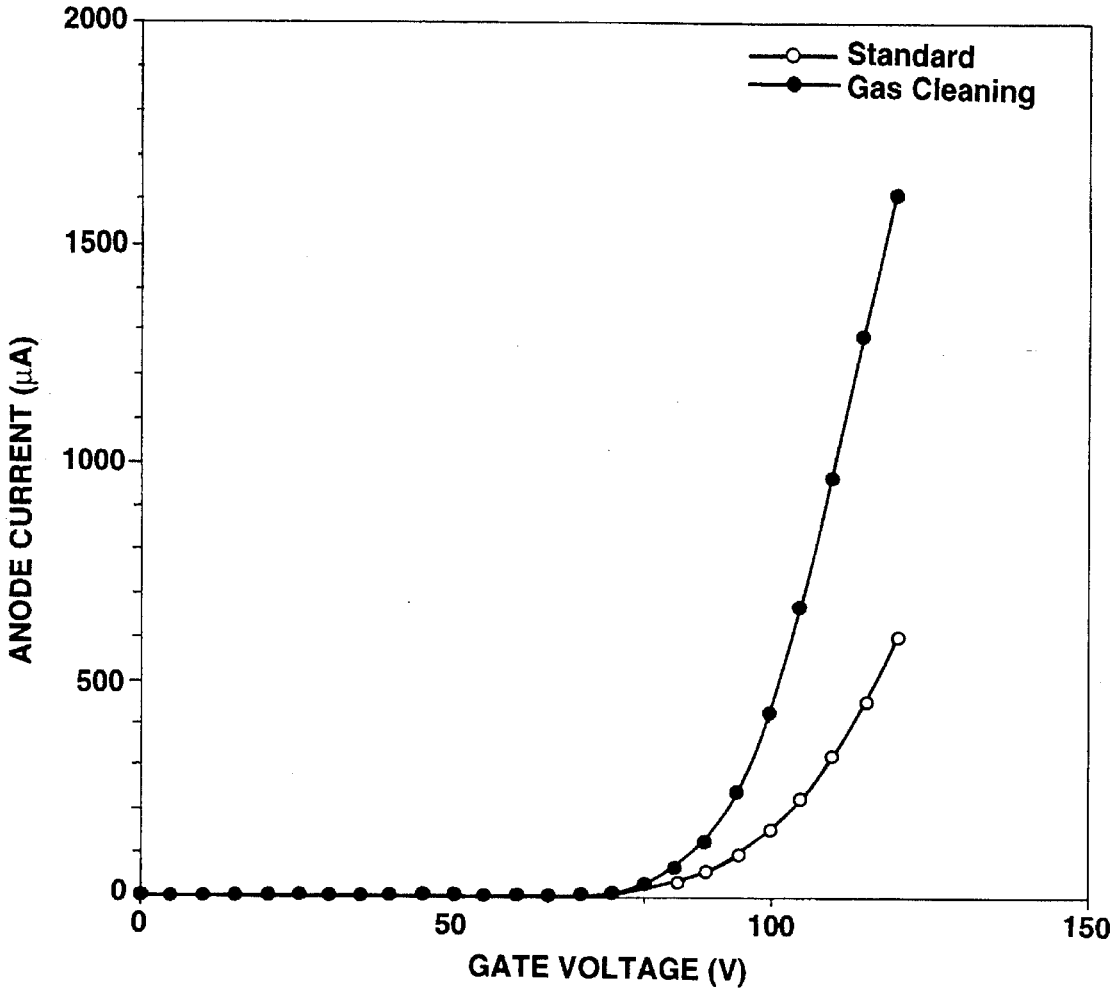
FIG. 7 is a graphical representation showing a variation in I–V characteristics of a display device by gas cleaning.
Figure 8:
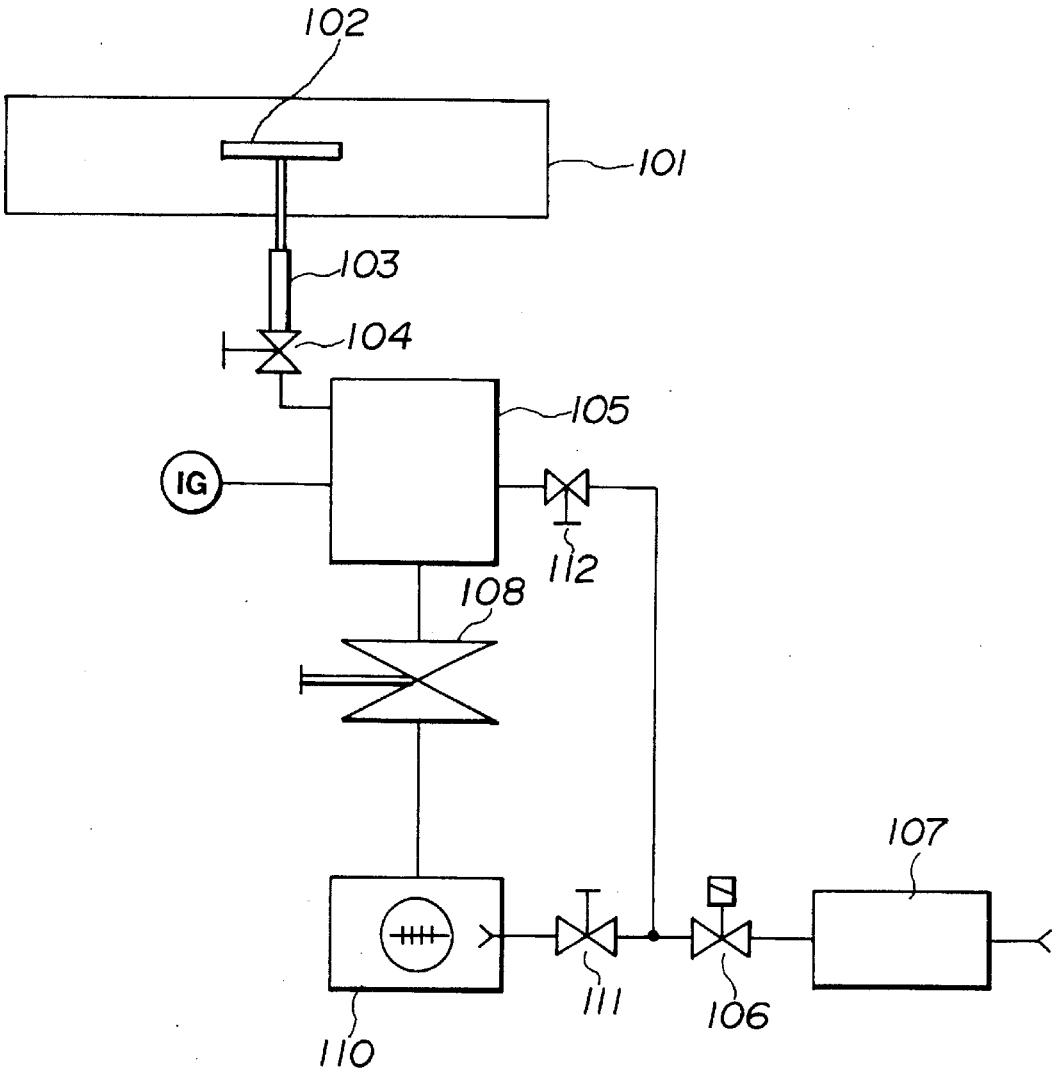
FIG. 8 is a diagrammatic view showing an apparatus for carrying out vacuum evacuation which has been generally used in a conventional method for manufacturing a display device.
Figure 9:
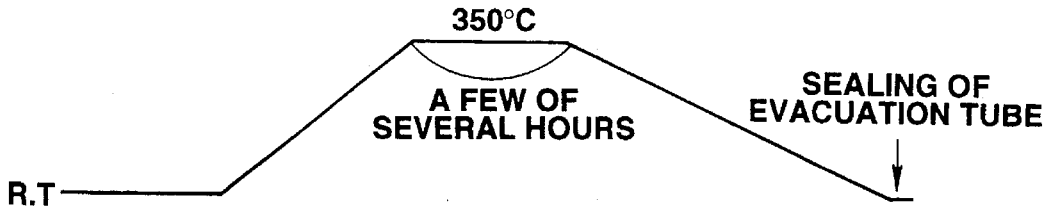
FIG. 9 is a diagrammatic view showing a temperature profile in a conventional method.

FIG. 7 shows a variation in I–V characteristics of a display device due to gas cleaning, wherein an axis of abscissas indicates a gate voltage and an axis of ordinates indicates an anode current. In FIG. 7, a line defined by connecting black dots to each other indicates I–V characteristics of a display device manufactured by the method of the present invention in which gas cleaning takes place and a line of white dots indicates those of a display device manufactured by the conventional method wherein gas cleaning does not take place. As will be noted from FIG. 7, the display device by the present invention permits a large amount of anode current to flow therethrough, when the gate voltage exceeds an electron emission start voltage to start flowing of the anode current. This would be due to the fact that the present invention permits the amount of molybdenum decreased in binding energy to be increased to a degree sufficient to facilitate emission of electrons from the electron emission means. For example, when gate voltage is set to be 120 V; the display device by the conventional method merely permits flowing of an anode current as low as 600 μA, whereas the display device by the method of the present invention permits an anode current to flow therethrough in an amount above 1600 μA which is about three times as large as that of the prior art. Thus, it will be noted that the present invention permits a display device to be remarkably increased in luminance.

Now, another or a second embodiment of a method according to the present invention will be described hereinafter.

A method of the second embodiment may be likewise practiced using the apparatus shown in FIG. 1. However, the second embodiment further requires a power supply for actuating the display device 2 placed in the chamber 1 and a wiring for the power supply.

Figure 3:
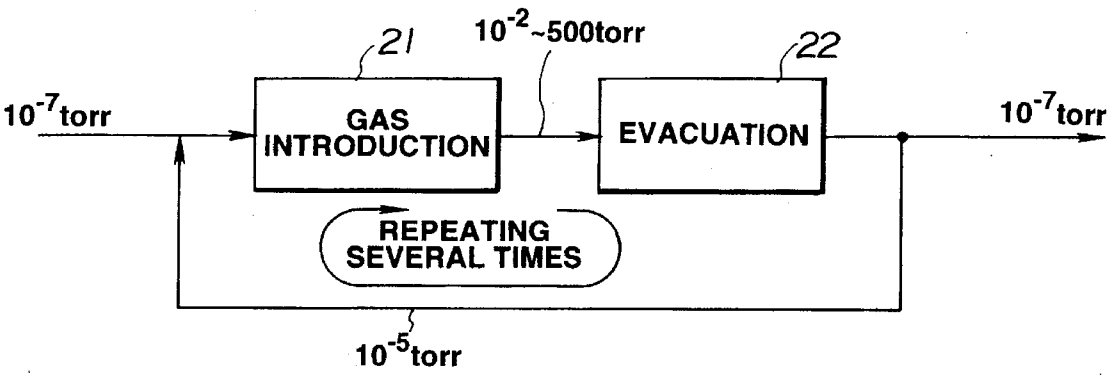
FIG. 3 is a diagrammatic view showing gas cleaning carried out in an embodiment of the present invention.

Now, a difference between the first embodiment and the second embodiment will be described hereinafter with reference to FIGS. 3 and 4. The second embodiment is different from the first embodiment in gas cleaning repeatedly carried out several times. More particularly, in the first embodiment, as shown in FIGS. 3, the display device is evacuated to a level of about $10^{-7}$ Torr and then a step 21 of introducing reducing gas into the display device and holding it therein is executed, followed by an evacuation step 21 of discharging the introduced reducing gas from the display device. Thus, in the first embodiment, gas cleaning is carried out by repeating the steps 21 and 22. Unfortunately, the gas cleaning carried out in the first embodiment often fails to fully discharge the reducing gas from the display device 2.

Figure 4:
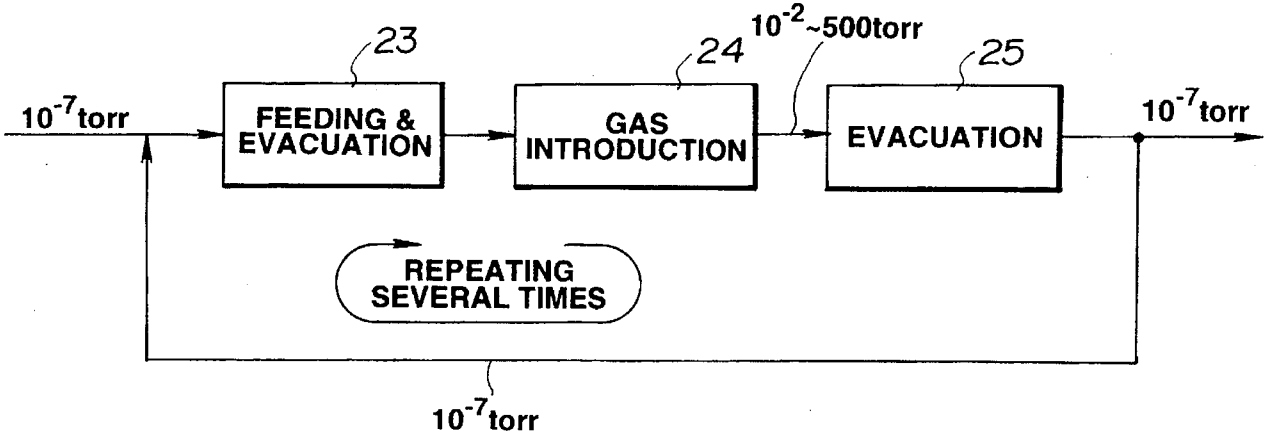
FIG. 4 is a diagrammatic view showing gas cleaning carried out in another embodiment of the present invention.

In view of such a disadvantage of the first embodiment, the second embodiment, as shown in FIG. 4, is so constructed that a display device 2 is evacuated to a level of about $10^{-7}$ Torr and then a feeding and evacuating step 23 is executed for feeding the display device 2 with electricity for a few or several minutes while carrying out evacuation of the display device 2. Then, a step 24 of introducing reducing gas into the display device to form a pressure of $10^{-2}$ to 500 Torr therein and holding the pressure therein for a few or several minutes is carried out, followed by an evacuation step 25 of discharging the reducing gas from the display device 2 to evacuate it to a level of about $10^{-7}$ Torr. The feeding and evacuating step 23, reducing gas introducing and holding step 24 and evacuation step 25 are repeated several times to carry out gas cleaning.

After completion of the gas cleaning, evacuation of the chamber 1 is carried out for about 6 hours while keeping a temperature in the chamber at about 300° C. and then an evacuation tube or a sealing lid is sealed to form a high vacuum in the display device 2.

The second embodiment thus constructed permits a cathode acting as an electron emission means in the display device 2 to be fed with electricity while keeping it at a high vacuum, leading to activation of the cathode. Also, this permits electrons emitted from the cathode to hit an anode, so that gas adsorbed on the anode may be readily discharged therefrom. In addition, the reducing gas introducing and holding step further facilitates discharge of gas adsorbed on the display device 2 therefrom, to thereby further improve life characteristics of the electron emission means and therefore the display device.

In the first and second embodiments described above, gas used for the gas cleaning is not limited to reducing gas. Weak reducing gas such as CO, $CO_2$ or the like may be used for this purpose. Alternatively, inert gas such as Ar or the like may be used for discharging of gas from the display device.

Also, when the display device includes a field emission cathode, introduction of gas such as $CH_4$, $C_2H_6$ or the like into the display device permits adhesion of carbon to a distal end of an emitter of a conical shape, leading to a decrease in work function, resulting in an advantage of increasing an emission current. The display device may be a fluorescent display device other than a display device including a field emission cathode.

As can be seen from the foregoing, the method of the present invention is so constructed that the gas introducing step and the evacuation step subsequent thereto are repeatedly carried out. Such construction of the present invention permits gas adsorbed on elements of a display device to be readily discharged therefrom to significantly improve life characteristics of the display device. In this instance, when gas introduced is reducing gas, it discharges the adsorbed gas from the display device while reducing oxidized elements of the display device.

Also, the method of the present invention may further include the feeding and evacuating step. Repeated execution of the step in combination with the gas introducing step and evacuation step further facilitates discharge of the adsorbed gas from the display device. In addition, in this instance, use of reducing gas permits the display device to be provided with further improved life characteristics. Also, this substantially improves current-voltage characteristics of the display device, resulting in an increase in luminance of the display device.

While preferred embodiments of the invention have been described with a certain degree of particularity with reference to the drawings, obvious modifications and variations are possible in light of the above teachings. It is therefore to be understood that within the scope of the appended claims, the invention may by practiced otherwise than as specifically described.

What is claimed is:

1. A method for manufacturing a display device, comprising the steps of:

placing a flat-type display structure in a heating chamber, the display structure includes a vacuum envelope and an electron emission means arranged in the vacuum envelope;

evacuating the display structure to a vacuum while subjecting the display structure to baking;

introducing reducing gas into the display structure evacuated to a vacuum and holding said reducing gas therein;

discharging said reducing gas from the display structure by evacuation to form a vacuum in the display structure;

repeating the steps of introducing said reducing gas and discharging said reducing gas a plurality of times;

further evacuating the display structure to a pressure at which the display structure is sealed without exposing the display structure to an atmosphere and sealing the display structure to thereby form the display device.

2. A method for manufacturing a display device, comprising the steps of:

(a) evacuating a display structure provided with at least an electron emission means to a vacuum;

(b) feeding the electron emission means with electricity while subjecting the display structure to baking;

(c) introducing a reducing gas into the display structure and holding said reducing gas therein;

(d) evacuating the display structure to a vacuum;

(e) repeating the steps b, c, and d a plurality of times;

(f) further evacuating the display structure to a pressure at which the display structure is sealed without exposing the display structure to an atmosphere and sealing the display structure to thereby form said display device.

* * * * *